US006815409B2

(12) United States Patent
Hsu et al.

(10) Patent No.: US 6,815,409 B2
(45) Date of Patent: Nov. 9, 2004

(54) GEL LAUNDRY DETERGENT AND/OR PRETREATER WHICH PILES UP AFTER DISPENSING

(75) Inventors: Feng-Lung Gordon Hsu, Tenafly, NJ (US); Yun-Peng Zhu, Fort Lee, NJ (US); Ronald Frederick Vogel, New York, NY (US); Agnes Boudou, Cliffside Park, NJ (US); Charles Ebert, Dumont, NJ (US); Kwang H Lee, Park Ridge, NJ (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/251,458

(22) Filed: Sep. 20, 2002

(65) Prior Publication Data

US 2004/0058840 A1 Mar. 25, 2004

(51) Int. Cl.[7] ..... C11D 17/00

(52) U.S. Cl. ..... 510/280; 510/277; 510/283; 510/336; 510/351; 510/403; 510/424; 510/426; 510/491

(58) Field of Search ..... 510/277, 280, 510/283, 336, 351, 403, 424, 426, 491

(56) References Cited

U.S. PATENT DOCUMENTS

| | | | | |
|---|---|---|---|---|
| 4,515,704 | A | 5/1985 | Akred et al. | 252/135 |
| 4,801,395 | A | 1/1989 | Chazard et al. | 252/99 |
| 4,900,469 | A | 2/1990 | Farr et al. | 252/96 |
| 5,538,662 | A | 7/1996 | Klier et al. | 252/122 |
| 5,820,695 | A | 10/1998 | Lance-Gomez et al. | 134/42 |
| 5,952,285 | A | 9/1999 | Hawkins | 510/405 |
| 5,952,286 | A | 9/1999 | Puvvada et al. | 510/417 |
| 5,972,869 | A | 10/1999 | Cao et al. | 510/292 |
| 6,001,795 | A | 12/1999 | Charlez et al. | 510/365 |
| 6,077,816 | A | 6/2000 | Puvvada et al. | 510/406 |
| 6,399,563 | B1 | 6/2002 | Durbut et al. | 510/413 |
| 2003/0171231 | A1 | 9/2003 | Shana'a et al. | 510/130 |

FOREIGN PATENT DOCUMENTS

| | | | |
|---|---|---|---|
| EP | 832 964 | 4/1998 | |
| GB | 2 351 979 A | 1/2001 | 3/20 |
| GB | 2 355 015 | 4/2001 | |
| WO | 99/06519 | 2/1999 | |
| WO | 99/27065 | 6/1999 | |
| WO | 03/060050 A1 | 7/2003 | 1/83 |

OTHER PUBLICATIONS

International Search Report, Application No. PCT/EP 03/09012 dated Aug. 13, 2003, 4 pages.
International Search Report, Application No. PCT/EP 03/09386 dated Aug. 22, 2003, 6 pages.
International Search Report, Application No. PCT/EP 03/08952 dated Aug. 13, 2003, 6 pages.
Co–pending Application: Applicant: Hsu et al., Filed: Sep. 20, 2002.
Co–pending Application: Applicant: Hsu et al., Filed: Sep. 20, 2002.
Co–pending Application: Applicant: Hsu et al., Filed: Sep. 20, 2002.

*Primary Examiner*—Necholus Ogden
(74) *Attorney, Agent, or Firm*—Rimma Mitelman

(57) ABSTRACT

Gel detergent compositions which pile-up on a surface, upon dispensing, to minimize the spreading of the gel to a substantially larger area. The gels that can pile up are less messy to use and provide better stain removal, since more detergent is concentrated on the desired area of fabric (e.g., the spot). The composition comprises from about 10% to about 35% of a surfactant, from about 0.1 to about 5% of a non-neutralized fatty acid; from about 50 to about 85% of water; with the total of anionic surfactants selected from soap, linear alkyl benzene sulfonic acid, primary and secondary alkyl sulfates being more than 50% of total surfactant level.

16 Claims, No Drawings

GEL LAUNDRY DETERGENT AND/OR PRETREATER WHICH PILES UP AFTER DISPENSING

FIELD OF THE INVENTION

The invention relates to gel detergent compositions which pile-up on a surface, upon dispensing, to minimize the spreading of the gel to a substantially larger area.

BACKGROUND OF THE INVENTION

Thickened or gel laundry products are preferred by many consumers, over either powder or liquid detergents. Gels provide the advantages of liquid detergents, but also can be used for pretreatment of fabrics, obviating the necessity for purchase of a separate pre-treatment product.

Gel detergents have been described. See, for instance, WO 99/06519 and WO 99/27065, Klier et al. (U.S. Pat. No. 5,538,662), GB 2 355 015, Lance-Gomez et al. (U.S. Pat. No. 5,820,695), Hawkins (U.S. Pat. No. 5,952,285), Akred et al. (U.S. Pat. No. 4,515,704), Farr et al. (U.S. Pat. No. 4,900,469).

Since gels are frequently also used as pretreaters, the desired property of gels is "pile-up," i.e. the property of a gel to pile up on the surface of the fabric, rather than spreading to a substantially larger area. The gels that can pile up are less messy to use and provide better stain removal, since more detergent is concentrated on the desired area of fabric (e.g., the spot).

SUMMARY OF THE INVENTION

The present invention includes a gel detergent composition which piles up upon dispensing, the composition comprising:

(a) from about 10% to about 35%, by weight of the composition, of a surfactant, (b) from about 0.1 to about 5%, by weight of the composition; of a non-neutralized fatty acid;

(c) from about 50 to about 85% of water;

(d) wherein the total of anionic surfactants selected from soap, linear alkyl benzene sulfonic acid, primary and secondary alkyl sulfates is more than 50% of total surfactant level.

Surprisingly, it has been discovered, as part of the present invention, that by employing non-neutralized fatty acid in a specific amount, depending on the total surfactant level, a shear-thinning, lamellar gel, with the desired pouring viscosity, can be attained at total surfactant level less than or equal to 35%, preferably less than 25%, most preferably less than 20%. Furthermore, it has been discovered that when the total level of anionic surfactants selected from soap, linear alkyl benzene sulfonic acid, primary and secondary alkyl sulfates is more than 50% of total surfactant level, gel wit the desired pile-up proiperty may be obtained.

The inventive product offers an advantage of laundry pre-treater and a detergent in a single product.

DETAILED DESCRIPTION OF THE INVENTION

Except in the operating and comparative examples, or where otherwise explicitly indicated, all numbers in this description indicating amounts of material or conditions of reaction, physical properties of materials and/or use are to be understood as modified by the word "about." All amounts are by weight of the gel detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Gel" as used herein means a shear thinning, lamellar gel, with a pouring viscosity viscosity in the range of from 100 to 5,000 mPas (milli Pascal seconds), more preferably less than 3,000 mPas, most preferably less than 1,500 mPas, and which also have the critical shear stress higher than 10 Pa, more preferably higher than 15 Pa, most preferably higher than 20 Pa, but nor to exceed 100 Pa. The concept of "gel" in the art is frequently not well defined. The most common, loose definition, however, is that a gel is a thick liquid. Nevertheless, a thick liquid may be a Newtonian fluid, which does not change its viscosity with the change in flow condition, such as honey or syrup. This type of thick liquid is very difficult and messy to dispense. A different type of liquid gel is shear-thinning, i.e.it is thick at low shear condition (e.g., at rest) and thin at high flow rate condition. The rheology of shear-thinning gel may be characterized by Sisko model:

$$\eta = a + b \times \dot{\gamma}^{n-1}$$

Where $\eta$ is Viscosity, mPA s, $\dot{\gamma}$ is shear rate, 1/sec, a, b are constants, and n is Sisko Rate index.

As used herein, "Shear-thinning" means a gel with the Sisco rate index less than 0.6.

Shear-thinning Theological properties can be measured with a viscometer or a sophisticated rheometer and the correct measurement spindle. The selection of spindle depends on the type of instrument. Generally, a cylindrical spindle needs a greater volume of sample; less sample is needed for either the disc or cone shape spindles. The protocol involves a steady state flow (SSF). The first step is conditioning step that pre-shears the sample at a set temperature (e.g. 25° C.). The time requirement depends on the type of sample: it generally takes from 30 seconds to an hour. The second step is the steady state flow step, which involves adjusting either shear stress (for a controlled stress rheometer only) or shear rate and collecting data after the sample has reached apparent equilibrium. To determine the flow behavior, the maximum shear rate and the ramp time can be arbitrarily chosen for the test program. During the test, up to 1000 data points can be gathered and the viscosity, shear stress, shear rate, temperature and test time at each point are stored. The plot of viscosity vs. shear rate will reveal whether the sample is shear thinning or not. A mathematical model, such as Sisko model, may be fitted to the data points.

As used herein, "pouring viscosity" means viscosity measured at a shear rate of 21 $s^{-1}$, which can be measured using the procedure described immediately above, or it can be read off the plot of viscosity vs. shear rate.

The critical shear stress is the shear stress at which viscosity drops dramatically. It is different than the zero shear stress which is the shear stress at zero shear rate. Critical shear stress may be estimated from the cliff of dropping viscosity on a plot of viscosity vs. shear stress.

As used herein, "lamellar" means that liquid crystals within the gel have lipid layers (sheets). Lamellar structures can be detected by polarized light microscope. Furthermore, majority of these lamellar sheets remain in a sheet form and only a very limited portion, say less than 10% of lamellar phase, is rolled up to form onion structure—like of vesicles.

As used herein, "lamellar gels" means gels that have lamellar phase structure, alone, in intermixed with isotropic phase (known as L1).

A sophisticated rheometer, such as AR-series from TA Instruments is needed for the measurement of G' and G". First, the Pseudo-linear viscoelastic region (LVR) is determined via an Osillatory Stress Sweep (OSS). The sample is then conditioned via timed pre-shear at a set temperature (e.g. 25° C.) so that its structure can equilibrate and so that the geometry to come to thermal equilibration before data acquisition begins. Next, a Stress Sweep step is performed. For an unknown sample, a good rule of thumb is to test over the allowable shear stress (torque) range of the instrument (e.g. 1–10,000 microN.m) and a frequency of 1 Hz. Finally, an Oscillatory Frequency Sweep is performed. The frequency range may be set between 100 Hz to 0.1 Hz. The % Strain or shear stress should be set to a value within LVR found the OSS step. The G' value from LVR is used to correlate to the Snap-Back phenomenon.

"Transparent" as used herein includes both transparent and translucent and means that an ingredient, or a mixture, or a phase, or a composition, or a package according to the invention preferably has a transmittance of more than 25%, more preferably more than 30%, most preferably more than 40%, optimally more than 50% in the visible part of the spectrum (approx. 410–800 nm). Alternatively, absorbency may be measured as less than 0.6 (approximately equivalent to 25% transmitting) or by having transmittance greater than 25% wherein % transmittance equals: $1/10^{absorbancy}\times100\%$. For purposes of the invention, as long as one wavelength in the visible light range has greater than 25% transmittance, it is considered to be transparent/translucent.

DETERGENT SURFACTANT

The compositions of the invention contain one or more surface active agents selected from the group consisting of anionic, nonionic, cationic, amphoteric and zwitterionic surfactants or mixtures thereof. The preferred surfactant detergents for use in the present invention are mixtures of anionic and nonionic surfactants although it is to be understood that anionic surfactant may be used alone or in combination with any other surfactant or surfactants. Detergent surfactants are typically oil-in-water emulsifiers having an HLB above 10, typically 12 and above. Detergent surfactants are included in the present invention for both the detergency and to create an emulsion with a continuous aqueous phase.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates.

Anionic surfactants may, and preferably do, also include fatty acid soaps—i.e., fully neutralized fatty acids.

One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates. Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R_1—O(CH_2CH_2O)_p—SO_3M,$$

where $R_1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10-18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

It should be noted that linear ethoxy sulfates (LES) acid is not stable. Accordingly, when LES is employed, it is pre-neutralized and used as 70% active paste, without hydrotrope, and is diluted during the processing.

The detergent compositions of the present invention are laundry compositions and consequently, preferably include at least 2% of an anionic surfactant, to provide detergency and foaming. Generally, the amount of the anionic surfactant is in the range of from 3% to 35%, preferably from 5% to 30% to accommodate the co-inclusion of nonionic surfactants, more preferably from 6% to 20% and, optimally, from 8% to 18%.

It has been discovered, however, as part of the present invention, that in order to attain the desired pile-up, the sum of anionic surfactants selected from soap, linear alkyl benzene sulfonic acid, primary and secondary alkyl sulfates (i.e., not alkoxylated or ethoxylated surfactants, or surfactants with EO/PO groups groups including nonionics) is more than 50% of total surfactant level, preferably more than 60%, most preferably more than 70%.

The anionic surfactant may be, and preferably is, produced (neutralized) in situ, to minimize processing cost, by neutralization of the precursor anionic acid (e,g. linear alkylbenzene sulfonic acid and/or fatty acid) with a base. Suitable bases include, but are not limited to monoethanolamine, triethanolamine, alkaline metal base, and preferably is sodium hydroxide and monoethanalamine mixture, because sodium hydroxide is the most economic base source and monoethanolamine offers better pH control.

Nonionic Surfactant

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature).

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 5 to 20. Of such materials it is preferred to employ those wherein the alkanol is a fatty alcohol of 9 to 11 or 12 to 15 carbon atoms and which contain from 5 to 8 or 5 to 9 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodol® trademark: Dobanol® 91-5 is an ethoxylated $C_9$–$C_{11}$ fatty alcohol with an average of 5 moles ethylene oxide and Dobanol® 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols or alyl phenols with relatively narrow contents of ethylene oxide in the range of from about 6 to 11 moles, and the $C_9$ to $C_{11}$ fatty alcohols ethoxylated with about 5–6 moles ethylene oxide.

Another class of nonionic surfactants which can be used in accordance with this invention are glycoside surfactants.

Generally, nonionics would comprise 0–32% by wt., preferably 5 to 30%, more preferably 5 to 25% by wt. of the composition.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference. As with the nonionic and anionic surfactants, the compositions of the invention may use cationic surfactants alone or in combination with any of the other surfactants known in the art. Of course, the compositions may contain no cationic surfactants at all.

Amphoteric Surfactants

Amphoteric synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis (2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The total amount of surfactant used may vary from 8 to 35%, preferably 10 to 30%, more preferably 12 to 25%.

As noted, the preferred surfactant systems of the invention are mixtures of anionic and nonionic surfactants.

Particularly preferred systems include, for example, mixtures of linear alkyl aryl sulfonates (LAS) and alkoxylated (e.g., ethoxylated) sulfates (LES) with alkoxylated nonionics for example in the ratio of the ratio of 2:1:1.

Preferably, the nonionic should comprise, as a percentage of an anionic/nonionic system, at least 20%, more preferably at least 25%, up to about 50% of the total surfactant system. A particularly preferred surfactant system comprises anionic:nonionic in a ratio of 1:1.

Non-Neutralized Fatty Acid

Any fatty acid is suitable, including but not limited to lauric, myristic, palmitic stearic, oleic, linoleic, linolenic acid, and mixtures thereof, preferably selected from fatty acid which would not form crispy solid at room temperature. Naturally obtainable fatty acids, which are usually complex mixtures, are also suitable (such as tallow, coconut, and palm kernel fatty acids). The preferred fatty acid is oleic acid because it is liquid at room temperature and its C18—chain helps to induce lamellar phase. Furthermore, it is also a builder and after neutralization, it can offer good detergency.

The amount of non-neutralized fatty acid depends on the amount of surfactant employed, and is determined by the Pileup Index Value as described below. Generally, the amount of non-neutralized fatty acid is in the range of from 0.1% to 5%, preferably from 0.2% to 4%, more preferably from 0.5 to 3%, to obtain optimum gels at minimum cost.

For the avoidance of doubt, the following pKa values were employed in the present invention to calculate the amount of non-neutralized fatty acid in the compositions:

Table of pKa Value of Fatty acids*

| Fatty acid chain length | Measured pKa value |
|---|---|
| 8 | 6.3~6.5 |
| 10 | 7.1~7.3 |
| 12 | ~7.5 |
| 14 | 8.1~8.2 |
| 16 | 8.6~8.8 |
| 16** | 8.5 |

*Cited from Langmuir, Vol 16, pp 172~177, 2000 (J. R. Kanicky, A. F. Poniatowski, N. R. Mehta, and D. O. Shah);
**Proc. R. Soc. London, A133, 140, 1931 (R. A. Peters).

Industrial grade Coco acid is a mixture of fatty acids containing C8 acid to C18 fatty acids. Also industrial grade Oleic acid is a mixture of fatty acids having C14 acid to C18 fatty acid. The difference in alkyl chain length in such a mixture of fatty acids can weaken the Van der Waals interaction between fatty acid molecules, and this results in an reduction in pKa value as compared with the pure fatty acid.

Ratio of Surfactant to Non-Neutralized Fatty Acid

In the especially preferred inventive compositions, weight % ratio of non-neutralized fatty acid to the total surfactant, A, is less than 1, but greater than or equal to the Pileup Index Value, P, defined by equation (I):

$$P=0.35-(0.01\times A) \quad \text{(I)}$$

The total surfactant does not include the amount of non-neutralized anionic surfactant precursors, but does include fully neutralized fatty acid soap surfactant.

If the ratio is greater than 1, the surfactant system may not solubilize all non-neutralized fatty acid and phase separation results. If the ratio is less than the Pile-up Value, P, the gel with the desired pile-up might not form.

pH pH of the inventive compositions is generally in the range of from 6 to 8, preferably from 6.2 to 7.8, more preferably from 6.5 to 7.5, most preferably from 6.8 to 7.4.

Water

The inventive compositions generally include water as a solvent and the carrier. Water amount is preferably in the range of from 50 to 90%, more preferably from 55 to 85%, most preferably from 60 to 80%.

Optional Ingredients

A particularly preferred optional ingredient(s) is a pH jump system (e.g., boron compound/polyol), as described in the U.S. Pat. No. 5,089,163 and 4,959,179 to Aronson et al., incorporated by reference herein. The inclusion of the pH jump system ensures that the pH jumps up in the washing machine to neutralize fatty acid, so as to obtain the benefits of neutralized fatty acid and to minimize surfactant amount.

Anti-Oxidant

A particularly preferred optional ingredient is an anti-oxidant. It has been found that the use of an anti-oxidant in conjunction with non-neutralized fatty acid, especially un-saturated fatty acid, e.g. Oleic acid, may prevent or substantially minimize the discoloration or yellowing of a gel. Suitable anti-oxidants include but are not limited to butylated hydroxytoluene (BHT), TBHQ (tert-butylhydroquinone), propyl gallate, gallic acid, Vitamin C, Vitamin E, Tannic acid, Tinogard, Tocopherol, Trolox, BHA (butylated hydroxyanisole), and other known-anti-oxidant compounds. BHT is preferred. Generally, from 0.0% to about 5.0%, preferably from 0.01% to 1%, more preferably from 0.03% to 0.5% may be employed.

Hydrotrope

Hydrotrope reduces and prevents liquid crystal formation. Generally, it is known that the addition of hydrotrope destroys gels. Surprisingly, it has been discovered that the addition of a low level of hydrotrope aids in the formation of inventive gels, while also improving the clarity/transparency of the composition. Suitable hydrotropes include but are not limited to propylene glycol, glycerine, ethanol, urea, salts of benzene sulphonate, toluene sulphonate, xylene sulphonate or cumene sulphonate. Suitable salts include but are not limited to sodium, potassium, ammonium, monoethanolamine, triethanolamine. Preferably, the hydrotrope is selected from the group consisting of propylene glycol, glyurine xylene sulfonate, ethanol, and urea to provide optimum performance. The amount of the hydrotrope is generally in the range of from 0 to 6%, preferably from 0.1 to 4%, more preferably from 0.2 to 3%, most preferably from 0.5 to 2%. The most preferred hydrotrope is propylene glycol and/or glycerine because of their ability, at a low level, to improve gel quality without destroying the structure.

Colorant

The colorant may be a dye or a pigment. Most preferably, a water-soluble dye (to prevent staining on clothes) is employed. The preferred compositions are blue.

Builders/Electrolytes

Non-neutralized fatty acid, especially unsaturated fatty acid, may also function as a builder.

Additional builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts. Most preferred electrolyte is borax, because it can be used in a complex form with polyol, which reserves an alkaline source until the composition is diluted. Thus, it neutralizes non-neutralized fatty acid, upon dilution in the washing machine. The level of borax is preferably from 0% to 15%, preferably 0.5 to 10%, more preferably 1 to 8%.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, (e.g. from 0 to 15%, preferably from 1 to 10%).

Certain zeolites or aluminosilicates can be used. One such aluminosilicate which is useful in the compositions of the invention is an amorphous water-insoluble hydrated compound of the formula $Na_x[(AlO_2)_y.SiO_2]$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

The preferred laundry composition may further include one or more well-known laundry ingredients, anti-redeposition agents, fluorescent dyes, perfumes, soil-release polymers, colorant, enzymes, enzyme stabilzation agents (e.g., sorbitol and/or borates), buffering agents, antifoam agents, UV-absorbers, etc.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

The compositions are preferably substantially free (i.e. contain less than 1%, preferably less than 0.5%, most preferably less than 0.1% of) of traditional thickening agents, such as ceoss-linked polyacrylates, polysaccaride gums (e.g. xantham), gellan, pectin, carrageenan, gelatin.

Use of the Composition

The compositions are used as laundry cleaning products (e.g., a laundry detergent, and/or a laundry pretreater). The inventive product offers an advantage of laundry pre-treater and a detergent in a single product. In use, a measured amount of the composition is deposited on the laundry or in the laundry washing machine, whereupon mixing with water, the cleaning of laundry is effected. It should be noted that due to the presence of non-neutralised fatty acid in the compositions, the compositions are low foaming and are particularly suitable for the use in front-loading laundry machines.

Process of Making Composition

The composition may be prepared by mixing the ingredients by any suitable method known in the art. According to the preferred method of making the compositions, the pre-mix containing all the ingredients, except either non-neutralized fatty acid or surfactant, or the base used to make the anionic surfactant, is prepared. The acid or the surfactant or the base are then added in the last step. The preferred method delays the gelling of the composition till the last step, thus simplifying manufacturing and ensuring the best mixing of the ingredients. Most preferably, the non-neutralised fatty acid and nonionic surfactant are mixed and added last, to the main mix containing the rest of the ingredients, the latter comprising an anionic surfactant. If antioxidant is included in formula, it is preferred added either with perfume or the premix of nonionic and fatty acid.

Container

The inventive compositions are opaque or transparent, and are preferably packaged within the transparent/translucent bottles.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

The following specific examples further illustrate the invention, but the invention is not limited thereto. The ingredients used for the Examples were as follows:

The following non-limiting examples illustrate the compositions of the present invention and methods of manufacture.

EXAMPLES 1–9

The Examples (all within the scope of the invention) were prepared by first preparing a main mix by mixing water, 70% sorbitol solution, propylene glycol, 50% sodium hydroxide solution, monoethanol amine and borax. After borax was dissolved under moderate agitation, sulfonic acid and coconut fatty acid (if the latter was an ingredient in the formulation) were added to the main mix. Mixing was continued until both acids were fully dispersed and neutralized or the full consumption of alkaline neutralizing agents. Enough sodium hyroxide was added to the solution to fully neutralize the LAS as well as acidic minors in the LAS such as sulphuric acid. A pre-mix was then prepared by mixing nonionic surfactant and oleic acid. Subsequently, the pre-mix was added into the main mix with agitation. The results that were obtained are summarized in Table 1. All Examples 1–9 resulted in the formation of a gel.

TABLE 1

| | % by weight of the composition Example No. | | | | | | | | |
|---|---|---|---|---|---|---|---|---|---|
| Ingredients | 1 | 2 | 3 | 4 | 5 | 6 | 7 | 8 | 9 |
| alkyl benzene sulfonic acid (LAS) | 6 | 4 | 4 | 6 | 4 | 4 | 4 | 5.73 | 5.73 |
| Non-ionic (C12–C14, 9 EO) | 6 | 4 | 4 | 6 | 4 | 4 | 4 | 3 | 6 |
| Oleic Fatty Acid | 6 | 4 | 8 | 6 | 4 | 8 | 4 | 3 | 6 |
| Coconut Fatty Acid | 0 | 8 | 0 | | 8 | | 8 | 3 | 0 |
| Sorbitol (70% solution) | 7.9 | 7.9 | 7.9 | 7.9 | 7.9 | 7.9 | 7.9 | 7.9 | 7.9 |
| Borax | 2.3 | 2.3 | 2.3 | 2.3 | 2.3 | 2.3 | 2.3 | 2.3 | 2.3 |
| NaOH (50% solution) | 1.6 | 1.07 | 1.07 | 1.6 | 1.07 | 1.07 | 1.07 | 1.53 | 1.53 |
| Monoethanolamine | 0.679 | 1.63 | 0.9 | 0.68 | 1.63 | 0.9 | 1.63 | 0.78 | 0.68 |
| Propylene Glycol | 0 | 2 | 0 | 0 | 2 | 0 | 2 | 2 | 0 |
| water and Miscellaneous | To 100 | To 100 | To 100 | To 100 | To 100 | To 100 | To 100 | To 100 | To 100 |
| Degree of FA Neutralization, % | 50 | 50 | 50 | 50 | 50 | 50 | 50 | 50 | 50 |
| pH | 7.2 | 7.36 | 7.16 | 7.1 | 7.02 | 7.42 | 7.02 | 7.13 | 7.03 |
| % Surfactant; A | 16.09 | 15.91 | 13.18 | 16.09 | 15.91 | 13.18 | 15.91 | 12.91 | 15.81 |
| % Fatty Acid | | | | | | | | | |
| Added | 6 | 12 | 8 | 6 | 12 | 8 | 12 | 6 | 6 |
| Non-neutralized | 3.00 | 6.00 | 4.00 | 3.00 | 6.00 | 4.00 | 6.00 | 3.00 | 3.00 |
| Weight % ratio of Non-neutralized Fatty Acid to Surfactant | 0.19 | 0.38 | 0.30 | 0.19 | 0.38 | 0.30 | 0.38 | 0.23 | 0.19 |
| Pile up Index, P | 0.189 | 0.191 | 0.218 | 0.189 | 0.191 | 0.218 | 0.190 | 0.220 | 0.19 |
| Sisko Index | 0.127 | 0.233 | 0.144 | 0.125 | 0.08 | 0.113 | 0.101 | 0.117 | 0.127 |
| Viscosity 21 1/sec | 715 | 1250 | 800 | 810 | 1920 | 1010 | 950 | 1020 | 1100 |
| Critical Shear Stress, Pa | 10.5 | 17.10 | 10.21 | 11.77 | 29.39 | 14.63 | 13.77 | 18.35 | 15.57 |

Examples 1 to 9 were all gels that piled up when when they were dispensed on fabric, Even for the low pouring viscosity as seen in Example 1 (viscosity only 715 mPas at 21 l/sec shear rate). Thus, these compositions are particularly suitable as pretreaters to remove stains.

COMPARATIVE EXAMPLES 10 AND 11

Examples 10 and 11 and (both outside the scope of the invention) demonstrate the criteria that a gel with pile up behaviour should have anionic surfactant more than 50% of total surfactant. Example 1 (within the scope of the invention) was used as a reference.

TABLE 2

| | % by weight of the composition Example No. | | |
|---|---|---|---|
| Ingredients | 1 | 10 | 11 |
| alkyl benzene sulfonic acid (LAS) | 6 | 2 | 1 |
| Non-ionic(C12–C14,9 EO) | 6 | 10 | 11 |
| Oleic Fatty Acid | 6 | 6 | 6 |
| Sorbitol (70% solution) | 7.9 | 7.9 | 7.9 |
| Borax | 2.3 | 2.3 | 2.3 |
| NaOH (50% solution) | 1.6 | 0.5342 | 0.26 |
| Monoethanolamine | 0.679 | 0.679 | 0.679 |
| water and Miscellaneous | To 100 | To 100 | To 100 |
| Degree of FA Neutralization, % | 50 | 50 | 50 |
| pH | 7.2 | 7.13 | 7.23 |
| % Surfactant; A | 16.09 | 15.82 | 15.75 |
| % Fatty Acid Added | 6 | 6 | 6 |
| Non-neutralized | 3.00 | 3.00 | 3.00 |
| Anionic surfactant | 10.1 | 5.82 | 4.75 |
| Anionic surfactant/Total surfactant, % | 62.77 | 36.79 | 30.12 |
| Weight % ratio of Non-neutralized Fatty Acid to Surfactant | 0.19 | 0.19 | 0.19 |
| Pile up Index, P | 0.19 | 0.19 | 0.19 |
| Critical Shear Stress, Pa | 10.5 | 6.55 | 4.48 |

Example 1 had anionic surfactants at a level of more than 50% of total surfactant level and showed pile up behavior. Comparative Examples 10 and 11 had the anionic surfactant at a level less than 50% of total surfactant level. Both Examples 10 and 11 did not show pile up behaviour. This was also evident from the critical shear stress of Comparative Examples 10 and 11 (less than 10 Pa).

What is claimed is:

1. A gel detergent composition which piles up upon dispensing, the composition comprising:

(a) from about 10% to about 35%, by weight of the composition, of a surfactant, (b) from about 0.1 to about 5%, by weight of the composition; of a non-neutralized fatty acid;

(c) from about 50 to about 85% of water;

(d) wherein the total of anionic surfactants selected from soap, linear alkyl benzene sulfonic acid, primary and secondary alkyl sulfates is more than 50% of total surfactant level.

2. The composition of claim 1, wherein the weight ratio of the non-neutralized fatty acid to the surfactant is less than about 1 but greater than or equal to the Pileup Index Value, P, defined by equation (I)

$$P=0.35-(0.01\times A) \quad (1),$$

wherein A is the total surfactant concentration.

3. The composition of claim 1 wherein the total surfactant amount is less than about 25%, by weight of the composition.

4. The composition of claim 1, wherein the composition is substantially free of gelling polymers and viscosifiers.

5. The composition of claim 1 further comprising from about 0 to about 6%, by weight of the composition, of a hydrotrope.

6. The composition of claim 1, wherein the composition is transparent/translusent.

7. The composition of claim 1 wherein the composition is packaged in a transparent container.

8. The composition of claim 1 wherein the pH of the composition is within the range of from about 6 to about 8.

9. The composition of claim 1 wherein the surfactant comprises an anionic surfactant.

10. The composition of claim 8 wherein the anionic surfactant comprises a mixture of a synthetic anionic surfactant and soap.

11. The composition of claim 1 wherein the surfactant comprises a mixture of an anionic surfactant and a nonionic surfactant.

12. The composition of claim 1 wherein the composition comprises from about 0.01% to about 5.0%, by weight of the composition, of an antioxidant.

13. The composition of claim 11 wherein the non-neutralized fatty acid in the composition is an unsaturated fatty acid.

14. The composition of claim 1 wherein the composition further comprises a pH jump system.

15. The composition of claim 1 wherein the composition further comprises from about 0.1 to about 6% of a hydrotrope.

16. The composition of claim 1 wherein the critical shear stress of the composition is higher than 10 Pa.

* * * * *